US006742609B2

(12) United States Patent
Gillis et al.

(10) Patent No.: US 6,742,609 B2
(45) Date of Patent: Jun. 1, 2004

(54) ROTATIONAL IMPACT DRILL ASSEMBLY

(75) Inventors: Peter J. Gillis, Carstairs (CA); Ian G. Gillis, Leduc (CA); Craig J. Knull, Edmonton (CA)

(73) Assignee: United Diamond Ltd., Nisku (CA)

( * ) Notice: Subject to any disclaimer, the term of this patent is extended or adjusted under 35 U.S.C. 154(b) by 26 days.

(21) Appl. No.: 09/852,321

(22) Filed: May 11, 2001

(65) Prior Publication Data

US 2002/0166700 A1 Nov. 14, 2002

(51) Int. Cl.[7] ..... E21B 10/36
(52) U.S. Cl. ..... 175/415; 175/293
(58) Field of Search ..... 175/293, 295, 175/296, 298, 305, 414, 415, 420.2, 417, 418, 57; 173/91, 78, 80, 93

(56) References Cited

U.S. PATENT DOCUMENTS 1,845,074 A * 2/1932 Billstrom ..... 175/298
3,223,187 A * 12/1965 Cleary ..... 175/293
3,316,986 A * 5/1967 Orr ..... 166/178
3,396,807 A * 8/1968 Menton ..... 175/293
3,970,152 A 7/1976 Harris et al.
3,971,450 A 7/1976 Fox
4,408,670 A 10/1983 Schoeffler
4,694,918 A * 9/1987 Hall ..... 175/414
RE33,711 E 10/1991 Ono et al.
5,906,244 A * 5/1999 Thompson et al. ..... 173/93.5

* cited by examiner

*Primary Examiner*—Thomas B. Will
*Assistant Examiner*—Meredith Petravick
(74) *Attorney, Agent, or Firm*—Sean W. Goodwin

(57) ABSTRACT

Apparatus is provided for introducing a consistent series of small and localized rotary impacts to a PDC bit during drilling, to improve PDC drill bit performance. Rotary impact supplements the nominal torque supplied by the rotary drive thereby avoiding lockup and potentially damaging energy storage in the drill string following windup, should the bit slow or hang up when drilling in difficult formations. The apparatus comprises a rotary hammer which is rotated about a bit shaft's anvil, preferably by a drilling fluid driven turbine. As the hammer rotates, potential energy is built up. When the hammer and anvil connect, the energy is released into the bit shaft and thus into the bit, increases its instantaneous torque and allows it to more effectively cut through difficult formations.

25 Claims, 5 Drawing Sheets

10
13
12
11
23
41
40
42
22
20
21
42
40
41
20
22
43
44
25
24
30
31
34
32
45
14
17
17
15
16

57
58
40
42
41
22
53
54
55
32
30
51
50
52
65
SECTION
63
15
OFF BOTTOM 57
58
22
40
41
42
40
41
42
61
60
53
50
15
ON BOTTOM
F 30
33
34
35
36
37
38
11

ROTATIONAL IMPACT DRILL ASSEMBLY

FIELD OF THE INVENTION

The present Invention relates to rotary Impact, torque intensifying apparatus for use with drill bits, particularly polycrystalline diamond compact "PDC" bits and methods of use applied to subterranean drilling.

BACKGROUND OF THE INVENTION

Conventional drill bits include roller bits which use compression to crush rock at the toolface when drilling a wellbore in a subterranean formation. It is known to apply axial impact assemblies for enhancing the compressive breaking action of percussive bits.

PDC bits, however, use a shearing action to break the material of the formation. Excessive axial force on a PDC bit is a known cause of failure of the cutters.

The PDC cutters and inserts of PDC bits are subject to failure through vibration and impact. Ideally, a PDC bit has continuous loading while shearing material at the toolface. However, when the rate of penetration suddenly slows, or when a hard interface is encountered, such as a stringer, the bit slows or hangs up, possibly even temporarily ceasing to rotate. Despite slowing or cessation of rotation of the drill bit, the drill string continues to rotate. Whether the bit is at the end of a rotating drill string, or at the end of a coiled tubing BHA, the rotary drive continues to wind up the drill string, building up torque and potential energy. Typically, the torque reaches a certain elevated level and the bit finally releases and spins violently, either due to the energy built up or due to a shortening of the drill string as it winds up. The sustained release of energy as the bit spins causes chatter or repeated impacts of the PDC cutters against the rock face—causing significant damage to the PDC bit cutters.

It Is an expensive process to trip out and replace a damaged PDC bit.

It is believed that PDC bit failure is caused by the chatter and impact associated with the sustained and violent release of the built up torque. Nevertheless, the lock up of a PDC bit is a known and persistent problem resulting in expensive down time and equipment cost

SUMMARY OF THE INVENTION

In a surprising discovery, PDC bit performance is improved and incidences of failure can be reduced by repeatedly applying increased torque at the PDC bit through the use of a rotary impact tool. So as to avoid large build up of torque and to suffer the associated sustained impact damage to a PDC bit on release, an assembly is provided for introducing a consistent series of smaller and localized rotary impacts to the bit, avoiding lockup and potentially damaging energy storage in the drill string.

The present invention implements a method and apparatus for increasing the drilling effectiveness of PDC bits while minimizing failures due to the release of energy following windup.

Simply, the method comprises increasing the effective torque of the drill bit by repeatedly and periodically intensifying the torque at the PDC drill bit. The periodic increases in torque avoid the potential for build-up of torque on bit lockup or sustained high torque incidences which are associated with PDC bit failure when the built-up of torque is released. Preferably, introduction of rotary impact is applied only during drilling.

In an apparatus aspect, a rotary torque impacting assembly is positioned between the drill bit and the rotary drive such as a rotary drill string or a downhole motor. The drill bit is adapted for rotation by the assembly which provides the nominal torque necessary to develop the shear forces used by the PDC bit to cut the formation. An energy source in the impacting assembly supplements the nominal torque provided by the rotary drive. Preferably, a drilling fluid driven turbine in the assembly drives a rotary hammer for periodic impacts with an anvil connected through to the drill bit.

The assembly comprises an output bit shaft for connection to the drill bit, and a housing for connection to the rotary drive. The bit shaft has a lower connection to the bit and an upper shaft end which projects into the downhole end of the housing and is rotatably driven thereby. The upper shaft end is fitted with a rotary anvil. The housing further houses a motor which rotates a hammer about the bit shaft's anvil. The motor spins the hammer and builds up its potential energy. When the anvil and hammer connect, the potential energy is released into the upper shaft end and thus into the drill bit, increasing its instantaneous torque and hence to cut through the difficult formation. For increased effectiveness, the bit shaft is adapted for permitting limited rotational freedom relative to the driving housing so that the bit shaft receives substantially all of the rotary impact. Preferably, the hammer's motor is impeded from operation when the bit is off bottom and not drilling.

BRIEF DESCRIPTION OF THE DRAWINGS

FIG. 2*a* illustrates the assembly when the bit shaft is off bottom so that the rotary drive is rotationally restrained;

FIG. 2*b* illustrates the assembly when the bit shaft is on bottom so that the rotary drive is free to rotate and impart rotational impact into bit shaft;

DESCRIPTION OF THE PREFERRED EMBODIMENT

Figure 1:
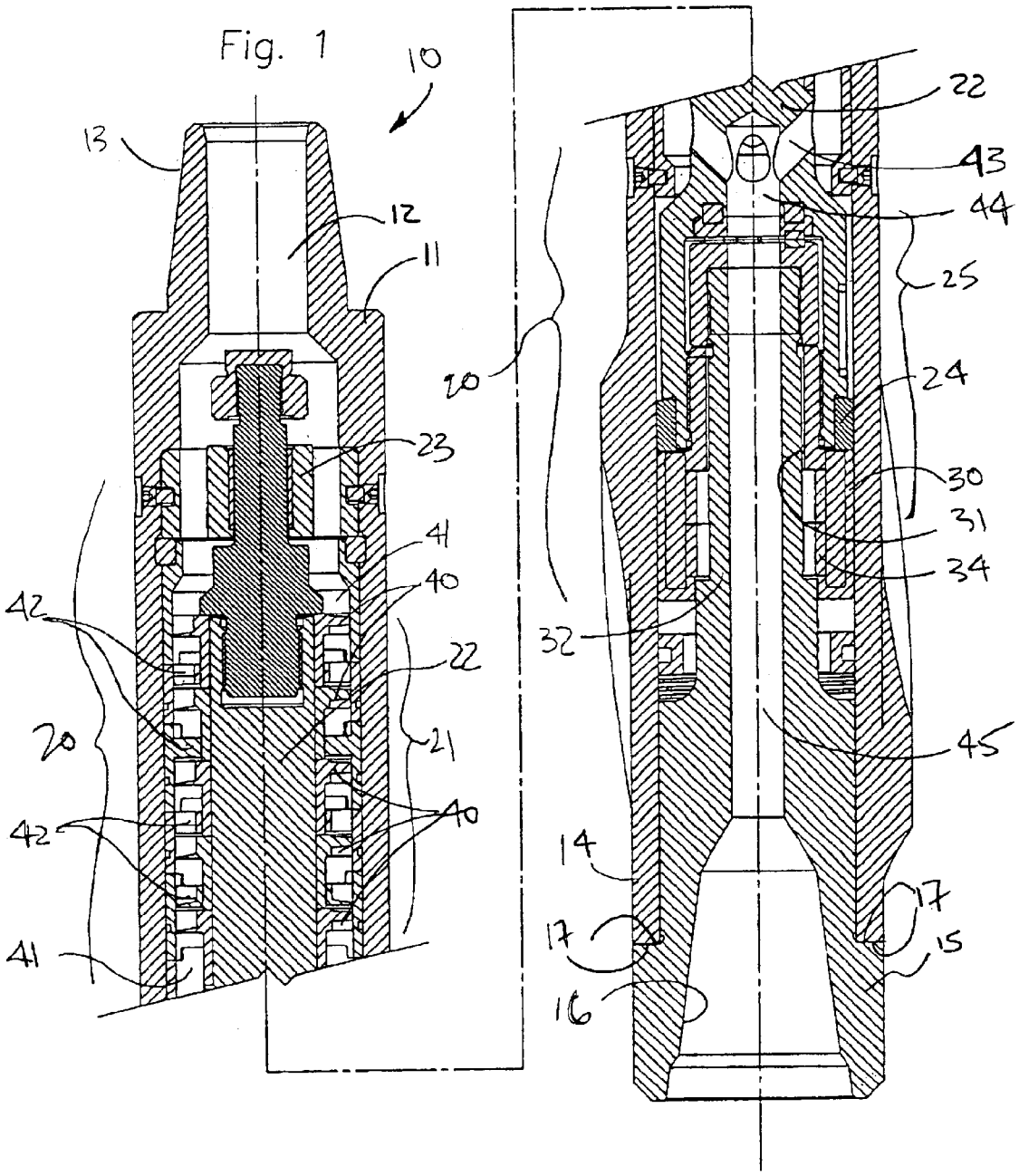
FIG. 1 is a cross-sectional view of one embodiment of a rotary impact assembly of the present invention.

Having reference to FIG. 1, a rotary impact tool of the present invention comprises an assembly 10 which is positioned between a rotary drive such as a rotary drill string or a downhole motor (not shown) and drill bit (not shown). The drill bit is typically employed to drill a wellbore through material in a subterranean formation. The assembly 10 comprises a driving housing 11 having a bore 12 and which is adapted for connection at a first end 13 to the rotary drive and at a second end 14 to a bit shaft 15 extending from the bore 12. The bit shaft 15 has a downhole end 16 which is adapted for connection to a drill bit, such as a bit fitted with PDC cutters. The bit shaft 15 is fitted to the housing 11 so that rotation of the drive housing 11 also rotates the bit shaft 15. Such co-rotation is achieved using a spline arrangement or interlocking castling 17 between the housing's end 14 and the bit shaft 15. A rotary impact assembly 20 is fitted into the housing's bore 12.

In one embodiment of an impact assembly 20, depicted in FIG. 1, the assembly 20 comprises a turbine motor 21 which provides the impetus for rotating a mass and storing potential energy. The turbine motor 21 is located within the bore 12 and is supported on a stator shaft 22 guided at an upper bearing 23 and at a lower bearing 24. The stator shaft 22 is enlarged at its lower end 25 for forming a hammer carrier 30 having a concentric cavity 31 formed therein. The carrier cavity 31 encircles an uphole end 32 of the bit shaft 15.

Figure 4A:
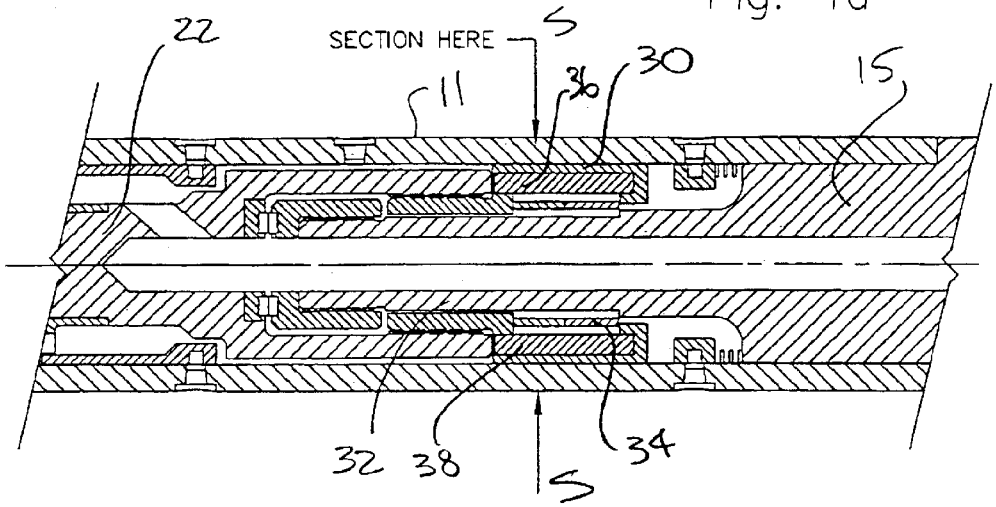
FIG. 4*a* is a partial cross-sectional view of the hammer carrier, hammer and anvil of the assembly according to FIG. 2*b;*
Figure 4B:
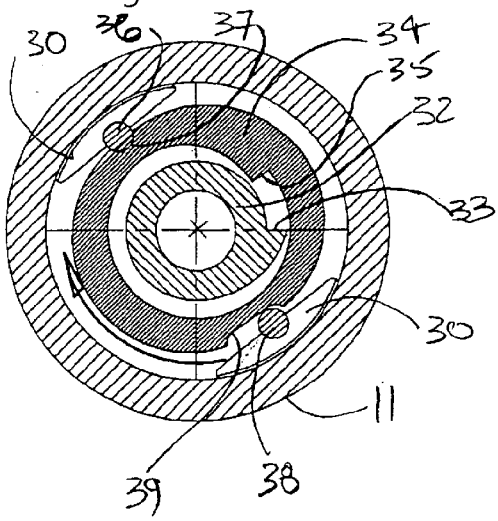
FIG. 4*b* is a cross-sectional view of the carrier according to the section S—S of FIG. 4*a*, illustrating the hammer in full rotation prior to impacting the anvil.
Figure 4C:
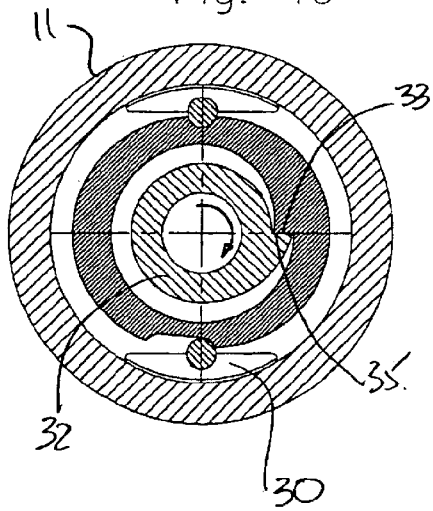
FIG. 4*c* is a cross-sectional view of the carrier of FIG. 4*b* at impact of the hammer and anvil.

Having reference also to FIGS. 4*a*–4*c*, the bit shaft's uphole end 32 has a radially outwardly projecting dog or anvil 33.

When the stator shaft 22 rotates, periodically, the rotating hammer 35 and the bit shaft's anvil 33 are coupled to impact and impart the potential energy of the moving hammer into the bit shaft.

The carrier 30 is fitted with an annular mass 34 having a radially inward projecting dog or hammer 35. The annular mass 34 is pivotable about a first pin 36 fitted to the carrier 30 at a tangent of the annular mass 34. The annular mass 34 has a first circular notch 37 at its tangent, the notch 37 being dimensionally sized so as to be pivotable about the first pin 36 and thereby permitting the annular mass 34 to move between concentric and eccentric positions about the bit shaft.

Diametrically opposite the first pin 36 is a second pin 38 secured in the carrier 30. A second elongated notch 39 is formed in the annular mass 34, diametrically opposite the first notch 37. The second notch 39 is elongated circumferentially and, forming stops spaced at about the same angular dimension as the length of the radially inward projection of the hammer 35. The second notch 39 is sized so that the annular mass's extreme eccentric position, the hammer 35 decouples or is released from the bit shaft's anvil.

Returning to FIGS. 1, 2*a* and 2*b*, the turbine motor 20 comprises a plurality of turbines 40 affixed to and spaced axially along the stator shaft 22. Each turbine 40 occupies an annular space 41 in the bore 12, formed between the stator shaft 22 and the housing 11. A plurality of complementary diffusers 42 are arranged, one per turbine 40 and are affixed in the annular space 41. Five turbines and four diffusers are shown.

A flow path is formed through the housing 11 and bit shaft 15 for conducting drilling fluids through the assembly 10 and to the bit. Drilling fluid flows into the assembly 10 from the rotary drive and into the bore 12 of the housing 11. Fluid then flows through the annular space 41 housing the diffusers 42 and turbines 40. Ports 43 are formed in the stator shaft 22 above the carrier 30 and conduct the drilling fluids from the turbines' annular space 41 and centrally into a bore 44 formed in the stator shaft 22. The bore 44 in the stator shaft 22 is contiguous with a bore 45 formed in the bit shaft 15 for conducting drilling fluid to the bit.

In an optional embodiment, it is advantageous to minimize assembly component wear by limiting the rotary impact operation to the actual drilling operations. There is little advantage in having the rotary impact operation occurring during running in and tripping out of the drill string. Accordingly, an arrangement is provided for arresting rotation of the turbine motor 20 until such time as the drill bit is on bottom of the drilled wellbore.

Figures 2A, 2B:
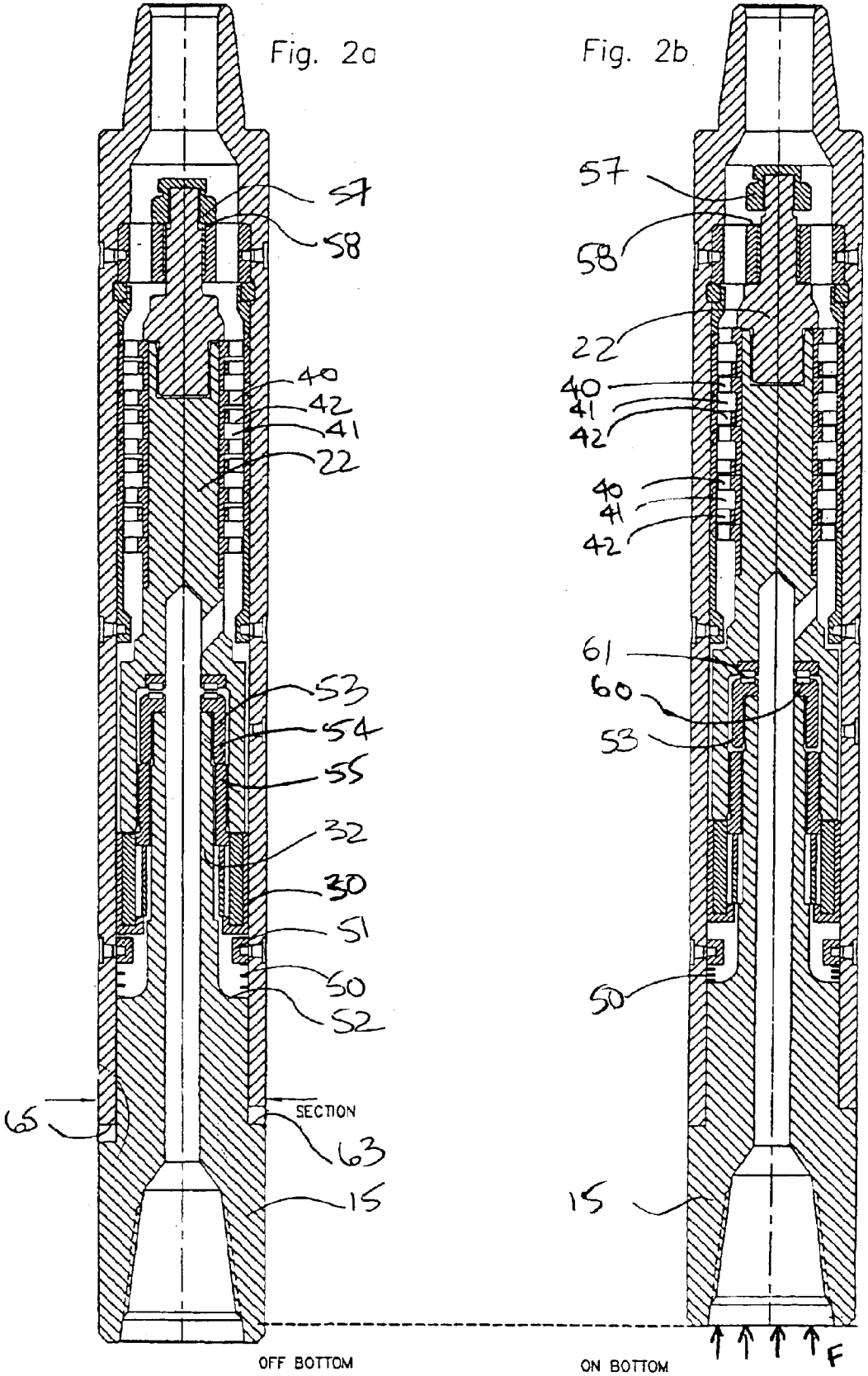
FIGS. 2*a* and 2*b* are cross-sectional views of the rotary impact assembly of FIG. 1.

Having reference to FIGS. 2*a* and 2*b*, the bit shaft 15 has limited axial movement responsive to weight on bit such as when contacted on the bottom of the wellbore being drilled. As shown in FIG. 2*a*, when off bottom, the bit shaft 15 is biased downwardly, binding the turbine motor 20 against rotation. In FIG. 2*b*, when on bottom, the bit shaft 15 is forced uphole which releases the turbine motor 20 for rotation.

Referring to FIG. 2*a*, while the bit shaft is not drilling and off bottom, an annular spring 50 biases the bit shaft 15 downhole. The spring 50 acts between an annular stop 51 and a shoulder 52 on the bit shaft 15. A cap 53 threaded onto the uphole end 32 of the bit shaft 15 has a base 54 which engages a shoulder 55 on the carrier 30, also biasing the stator shaft 22 downhole. When biased downhole, each turbine 40 shifts freely and axially within the annular space 41 and within an axial tolerance provided between diffusers 42. At the top of the stator shaft 22, a capping nut 57 moves axially downhole with the stator shaft 22 and engages a braking surface or frictional interface 58. Even through the shaft 22 is frictionally restrained, drilling fluid can continue to flow substantially unimpeded through the turbines 40 and through to the bit shaft 15 and bit.

Referring to FIG. 2*b*, when the bit shaft 15 is on bottom and drilling, the reactive force F overcomes the spring 50 and shifts the bit shaft 15 axially uphole. A thrust bearing 60 is fitted to the top of the cap 53. A complementary thrust bearing 61 is fitted into the carrier cavity 31. One suitable set of bearings 60, 61 include facing PDC surfaces. The uphole axial shift of the bit shaft 15 also drives the carrier 30 and stator shaft 22 uphole, lifting and disengaging the capping nut 57 from the frictional braking surface 58, freeing the stator shaft 22 for rotation when drilling fluids flow through the turbines 40 and diffusers 42, and initiating rotary impact operation.

Having reference to FIGS. 4*a*–4*c* and FIGS. 5*a*–5*h*, in operation, the rotating stator shaft 22 rotates the carrier 30 and annular mass 34 (FIG. 4*b*). Each revolution of the stator shaft 22 brings the hammer 35 into impact contact with the bit shaft's anvil 33 (FIG. 4*c*) for periodically and rotatably impacting the bit shaft 15 for intensifying the torque applied to the drill bit. Each impact converts the potential energy of the rotating annular mass 34 into increased torque. The momentum of the annular mass 34 is transferred into the bit shaft 15 and the bit, briefly yet energetically aiding in bit rotation despite resistance encountered by the bit.

In repeated and periodic cycles, and having reference to FIGS. 5*a*–5*h*, after each impact, the annular hammer 35 is able to recover and rotate once again to raise its potential energy for the next impact. Despite the periodic impact which, for each cycle, arrests the annular hammer's rotation, the hammer 35 is caused to disengage from the anvil 33 and begin the annular mass's cycle of rotation once again.

Figures 5A, 5B, 5C, 5D, 5E, 5F, 5G, 5H:
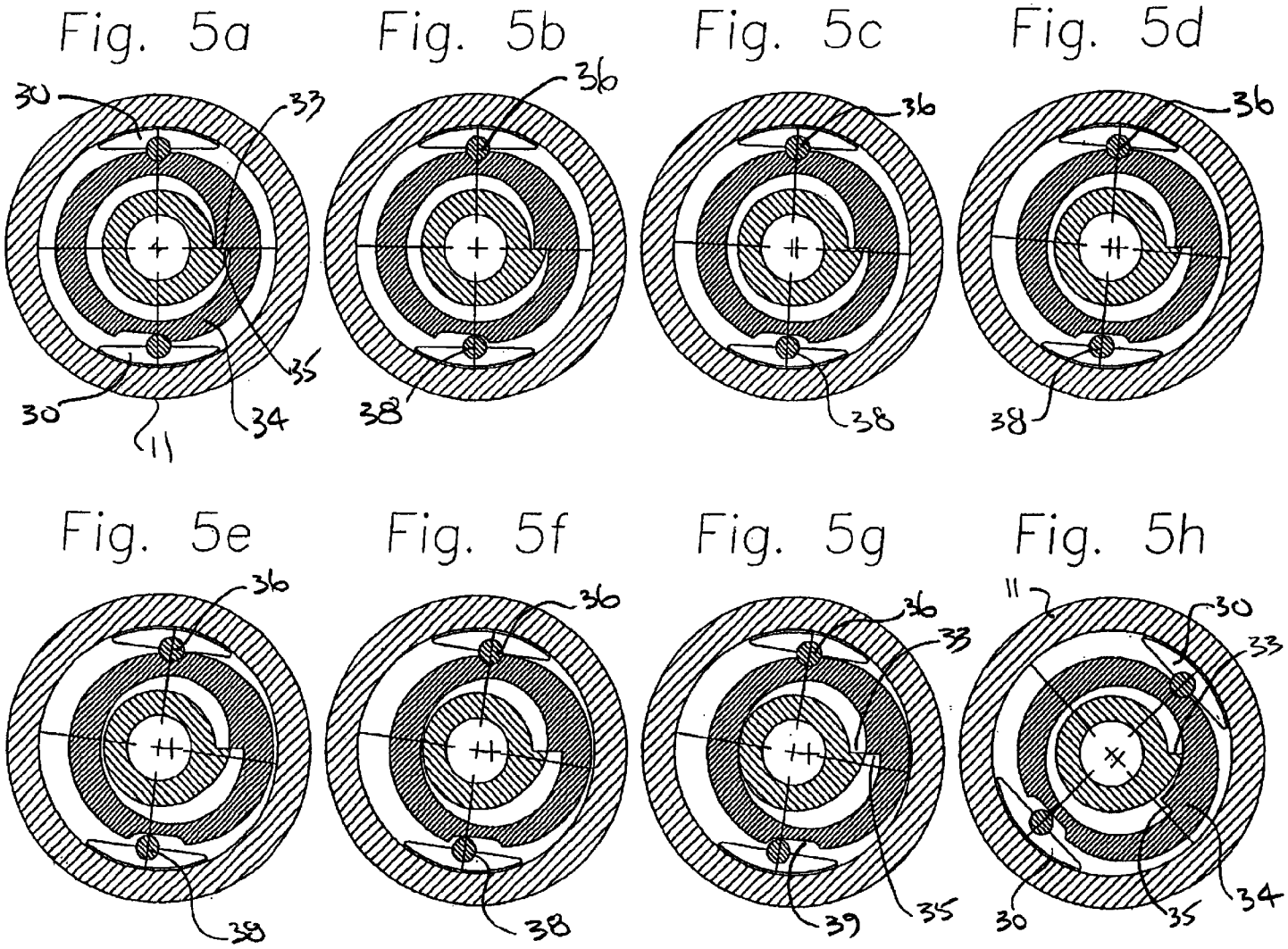
FIGS. 5*a*–5*h* are sectional views according to section S—S of FIG. 4*a*, illustrating the hammer, hammer carrier and anvil of the assembly and sequential views of the transfer of rotational impact energy from impact through to release of the hammer.

In FIG. 5*a*, in a first step of the cycle, the impact of hammer and anvils 35,33 is depicted. In FIG. 5*b*, the energy of the impact causes the annular hammer 35 to begins to pivot about the first pin 36. As shown in FIGS. 5*c*–5*f*, the annular hammer 35 continues to pivot about the first pin 36, enabled by a shifting of the elongated second notch 39 along the second pin 38, permitting pivoting to continue unchecked. The center of the annular hammer 35 progressively shift so that eventually the hammer and anvils 35,33 separate radially. As shown at FIG. 5*h*, at the end of the impact cycle, the hammer and anvils 35, 33 have fully disengaged and the turbine motor 30 is free once again to rotate the annular hammer 35 through the next rotation to initiate the next impact cycle.

Figure 3B:
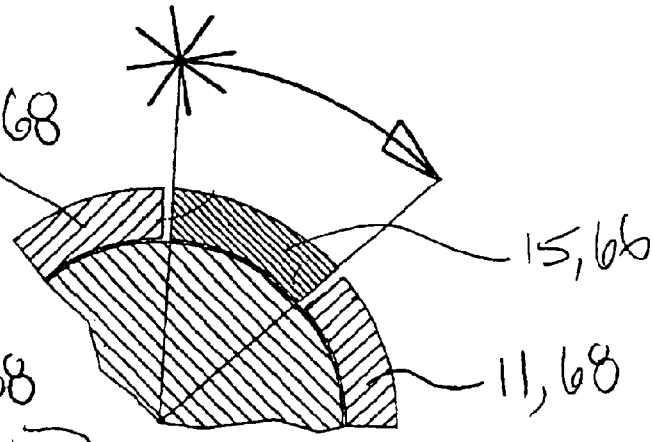
FIG. 3*b* is a partial cross-sectional view of the housing and bit shaft of FIG. 3*a* immediately after impact of the hammer and anvil.
Figure 3A:
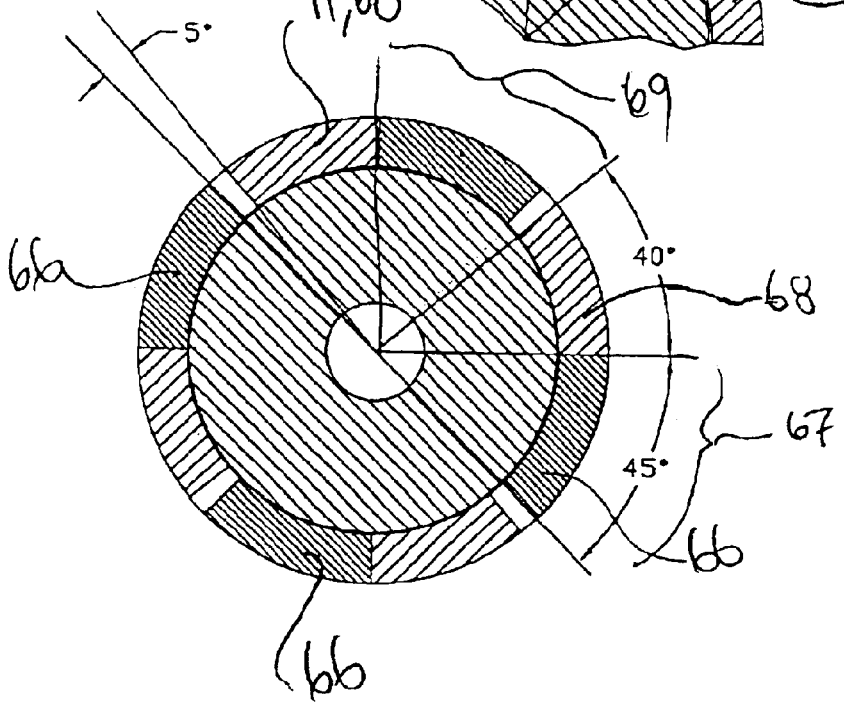
FIG. 3*a* is a cross-sectional view of the housing and bit shaft interlocking castled interface during drilling operations prior to impact according to FIG. 2*b;*

Having reference to FIGS. 2*a*, 3*a* and 3*b*, the energy released into the bit shaft 15 is most effective if it is directed substantially entirely into the materials being drilled. The least effective energy transfer is that which is imparted and absorbed by the mass of the entire drill string. Accordingly, the bit shaft 15 is partially decoupled rotationally from the housing 11 for permitting limited rotational freedom. As shown on FIG. 2*a*, the bit shaft 15 forms a shoulder 63 at the interface of the bit shaft 15 to an end face 65 of the housing 11. This housing end face 65 and bit shaft shoulder 63 interface is fitted with complementary castled faces of alternating axially projecting dogs.

Turning to FIGS. 3*a* and 3*b*, in one embodiment, four axial bit shaft dogs 66, each having a 45° arc, are circumferentially spaced on the bit shaft shoulder forming four annular gaps 67 of about 45° each. Four corresponding axial housing dogs 68, each having a 40° arc, are also circumferentially spaced on the housing's end face 65 forming four annular gaps 69 of about 50° each. When drilling, the 40° housing dogs 68 advance to engage the bit shaft's 45° annular gaps. Correspondingly, the 45° bit shaft dogs 66 advance to engage the housing's 50° annular gaps 69. The housing's bit shaft dogs 68 rotationally drive the bit shaft 15 which drives the bit to drill. Accordingly, the bit shaft 15 has a limited independent rotational capability.

Each impact of the hammer and anvils 35, 33 causes the bit shaft 15 to be driven momentarily and rotationally ahead of the housing's rotation, the bit shaft shoulder dogs 66 advancing ahead of the housing's dogs 68 so as to absorb substantially all of the energy in the annular hammer 34 and imparting it into the drill bit without involving the assembly or the drill string.

The embodiments of the invention in which an exclusive property or privilege is claimed are defined as follows:

1. A method for drilling a subterranean formation comprising the steps of:

rotating a housing for driving a drill bit at a rotational speed at least equal to a rotational speed of the housing so as to drill the formation;

storing potential energy, and periodically imparting the potential energy into the drill bit for periodically driving the drill bit at a rotational speed greater than that of the housing and increasing drilling torque.

2. The method of claim 1 wherein the storing and releasing of the potential energy comprises the steps of:

rotating an inertial hammer to store potential energy; and periodically impacting the rotating inertial hammer with a rotary anvil on the drill bit to impart the stored potential energy to the drill bit.

3. The method of claim 2 wherein the rotary impact is only imparted to the drill bit when the drill bit bears against the formation.

4. A method for drilling a subterranean formation with a PDC drill bit depending from a drill string, the method comprising the steps of:

providing an assembly adjacent the drill bit;

rotating the assembly to rotate the drill bit at a rotational speed at least equal to a rotational speed of the assembly;

rotating a hammer to store potential energy in the assembly; and periodically impacting the rotating hammer with an anvil on the drill bit so as to impart the stored potential energy to the drill bit for periodically driving the drill bit at a rotational speed greater than that of the housing and increasing drilling torque.

5. The method as described in claim 4 wherein the hammer is rotated using drilling fluid.

6. A rotational impact assembly for a drill bit comprising:

a housing adapted to be rotated by a first rotary drive;

a drill bit extending from the rotating housing for co-rotation at a rotational speed at least equal to a rotational speed of the housing; and a second rotary drive located in the housing for periodically and rotatably impacting the drill bit to increase drilling torque.

7. The rotational impact assembly of claim 6 further comprising a bit shaft through which the drill bit is rotatably driven, the drill bit being adapted for limited rotation relative to the housing so that when rotationally impacted, the bit shaft receives the energy substantially independent of the housing whereby the drill bit receives substantially all energy from the rotary impact.

8. The rotational impact assembly of claim 6 wherein the second rotary drive is a motor driven by drilling fluids.

9. The rotational impact assembly of claim 6 wherein the first rotary drive is a rotating end of the drill string.

10. The rotational impact assembly of claim 8 wherein the motor is a turbine.

11. The rotational impact assembly of claim 8 further wherein the motor comprises a stator shaft having a first downhole position and in which a frictional interface is engaged between the stator shaft and the housing to prevent operation of the motor, and a second uphole position in which the frictional interface is disengaged for permitting operation of the motor.

12. A rotational impact assembly for a drill bit comprising:

a housing adapted to be rotated by a first rotary drive, the housing having a bore;

a motor located in the bore for rotating a stator shaft;

a bit shaft extending from the bore of the housing and being adapted at a downhole end for rotatably driving the drill bit;

means for normally driving the drill bit with the housing at a rotational speed at least equal to a rotational speed of the housing; and means for periodically coupling the stator shaft and bit shaft for co-rotation whereby rotational energy is transferred from the stator shaft to the bit shaft for increasing dulling torque.

13. The rotational impact assembly of claim 12 wherein the coupling means comprise:

an annular mass rotated by the stator shaft and having a radially extending hammer; and an anvil extending radially from the bit shaft and adapted to be impacted by the hammer.

14. The rotational impact assembly of claim 13 further comprising:

a carrier driven by th stator shaft and in which the annular mass is carried about the bit shaft;

means for alternating the position of the annular mass between concentric and eccentric positions about the bit shaft upon each rotation of the stator shaft, the carrier and annular mass being rotated concentrically so as to cause the hammer and anvil to couple, and the annular mass then moving eccentrically so as to decouple the hammer from the anvil.

15. The rotational impact assembly of claim 14 wherein the means for alternating the annular mass position comprises:

a first pin affixed in the carrier and at a tangent of the annular mass for enabling the annular mass to pivot eccentrically;

a second pin affixed in the carrier diametrically opposed to the first pin and at a tangent of the annular mass, the annular mass having circumferentially elongated notch formed in its tangent for permitting limited the eccentric movement of the annular mass, the eccentric movement being sufficient to decouple the hammer and anvil.

16. The rotational impact assembly of claim 13 further comprising:

a carrier driven by the stator shaft for carrying the annular mass about the bit shaft; and an offset pin in the carrier about which the annular mass can pivot between concentric and eccentric positions about the bit shaft so that upon each rotation of the stator shaft, the carrier and annular mass are rotated concentrically so as to cause the hammer and anvil to couple after which the annular mass pivots to the eccentric position so as to decouple the hammer from the anvil.

17. The rotational impact assembly of claim 16 further comprising a second pin in the carrier and diametrically opposed to the first offset pin, the annular mass having circumferentially spaced stops which alternately position the annular mass between the concentric and eccentric positions.

18. The rotational impact assembly of claim 13 wherein the motor is rotated by drilling fluids flowing to the drilling bit.

19. A rotational impact assembly for a drill bit comprising:

a housing adapted to be rotated by a rotary drive;

a bit extending from the housing and being rotatably driven thereby; and a motor located in the housing, driven by drilling fluids and comprises a stator shaft having a first downhole position and in which a frictional interface is engaged between the stator shaft and the housing to prevent operation of the motor, and a second uphole position in which the frictional interface is disengaged for permitting operation of the motor, for periodically and rotatably impacting the drill bit.

20. The method of claim 1 further comprising:

rotating a motor in the housing to store potential energy;

rotating a inertial hammer with the motor; and periodically impacting the rotating hammer with an anvil on the drill bit.

21. The method of claim 20 further comprising providing drilling fluid through the housing to drive the motor.

22. The method of claim 20 further comprising flowing drilling fluids to the drilling bit for driving the motor.

23. The method of claim 20 further comprising:

rotating the motor while the drill bit is drilling for performing the storing of potential energy and periodically imparting the stored potential energy into the drill bit; and braking the motor while the drill bit is not drilling.

24. The rotational impact assembly of claim 12 comprising means positioned between the housing and the drill bit for permitting limited rotation therebetween so that the drill bit, when impacted, receives substantially all rotational energy from the rotary impact.

25. The rotational impact assembly of claim 24 wherein the rotation limiting means comprises cooperating castellation between the housing and the drill bit.

* * * * *